US006925910B2

(12) United States Patent
Alford

(10) Patent No.: US 6,925,910 B2
(45) Date of Patent: Aug. 9, 2005

(54) RATCHET TOOL

(76) Inventor: Larry Alford, 17 Engler Street, Booragoon, Western Australia 6154 (AU)

( * ) Notice: Subject to any disclaimer, the term of this patent is extended or adjusted under 35 U.S.C. 154(b) by 0 days.

(21) Appl. No.: 10/398,290

(22) PCT Filed: Oct. 8, 2001

(86) PCT No.: PCT/AU01/01261

§ 371 (c)(1),
(2), (4) Date: Apr. 11, 2003

(87) PCT Pub. No.: WO02/30623

PCT Pub. Date: Apr. 18, 2002

(65) Prior Publication Data

US 2004/0040419 A1 Mar. 4, 2004

(30) Foreign Application Priority Data

Oct. 11, 2000 (AU) ..... PR0698

(51) Int. Cl.[7] ..... B25B 17/00
(52) U.S. Cl. ..... 81/57.29; 81/58.1; 81/62
(58) Field of Search ..... 81/57.29, 58.1, 81/58.3, 60, 62, 63.1, 124.6, 177.85

(56) References Cited

U.S. PATENT DOCUMENTS

| | | | | | |
|---|---|---|---|---|---|
| 3,005,367 | A | * | 10/1961 | Vose | 81/125 |
| 4,137,801 | A | * | 2/1979 | Imperio | 81/58.1 |
| 4,532,832 | A | * | 8/1985 | Christensen | 81/57.29 |
| 4,967,624 | A | | 11/1990 | Farris | |
| 5,058,463 | A | * | 10/1991 | Wannop | 81/57.29 |
| 5,887,493 | A | * | 3/1999 | Main | 81/57.29 |

FOREIGN PATENT DOCUMENTS

| | | |
|---|---|---|
| DE | 197 14 921 A1 | 10/1998 |
| DE | 200 10 055 U1 | 10/2000 |
| WO | WO 91/10540 | 7/1991 |

* cited by examiner

*Primary Examiner*—Hadi Shaker
(74) *Attorney, Agent, or Firm*—Edell, Shapiro & Finnan

(57) ABSTRACT

A ratchet tool includes a head and a ratchet mechanism for rotation about a first axis, a body for carrying a tool element, and a handle coupled to the head for rotation about a second axis perpendicular to the first axis, where the handle is movable axially between first and second positions. The ratchet tool is configured such that torque can be imparted to the body, to rotate a tool element carried thereby, by turning the handle about the second axis when the handle is in the first position or by moving the handle about the first axis when the handle is in the second position.

6 Claims, 2 Drawing Sheets

12
10
82
24
108
106
80
78
86
14
30
18
62
64

76
68
74
70
72
60
18
66
62
64

26
12
44
42
22
16
14
30
54

46
12
48
42
44
50
14
28
52
34

58
56

26 14 38 28
50
42
12

108
106

88
78
80
82
16

94
100
104
96
102
106
92
98

16
80
82
78
84
36
38
40
88

94
106
100
96
92

86

RATCHET TOOL

FIELD OF THE INVENTION

The present invention relates to a ratchet tool and in particular, but not exclusively to a ratchet socket type spanner.

BACKGROUND OF THE INVENTION

Ratchet socket spanners are very well known tools. These type of spanners have a handle provided at one end with a ratchet mechanism. A square pin extends from the ratchet mechanism at right angles to the handle. The pin is able to receive interchangeable sockets for engaging nuts and bolts of different size. The ratchet mechanism typically includes a switch to allow the spanner to operate in a clockwise or anticlockwise direction as required. Some ratchet mechanisms also provide a central locked position allowing the spanner to operate in both the clockwise and anticlockwise directions with no ratcheting.

One problem with the conventional ratchet spanner is that at times the environment in which it is used allows only very limited movement of the handle so that the handle must be reciprocated many many times within the limitations of its movement in order to perform the task at hand. For example, the motion of the handle may be limited to say one or two "ratchet clicks". This of course makes the job at hand very tedious.

SUMMARY OF THE INVENTION

It is an object of the present invention to provide a ratchet tool in which torque can be delivered to a ratchet mechanism via a handle moved about either one or both of two substantially perpendicular axis.

According to the present invention there is provided a ratchet tool including at least:

a head provided with a hole having a first axis and an inner circumferential surface;

a neck depending from said head and provided with a longitudinal passage extending along a second axis perpendicular to said first axis, said passage opening at one end on to said inner circumferential surface, and at an opposite end at an end of said neck distance said head;

a ratchet mechanism including: a body provided with pawl means, said body disposed in said hole; and, a gear formed on and about said inner circumferential surface for engagement with said pawl means;

a handle rotatably retained in said neck and having a length extending into said passage; and, coupling means for enabling coupling said handle to said body;

whereby, torque can be imparted to said body from said handle, via said coupling means when said handle is rotated about said second axis, or via said neck and head when said handle is moved about a said first axis.

Preferably said coupling means includes first and second mutually engageable elements, said first element provided on said body and said second element provided on said handle.

Preferably said handle is axially moveable along said second axis between a first position where said first and second elements are engaged whereby, rotating of said handle about said second axis causes rotation of said body about said first axis, and a second position where said first and second elements are disengaged whereby said handle can freely rotate relative to said neck about said second axis without causing rotation of said body.

Preferably said first element is a ring gear formed about said body and said second element is a pinion gear formed at an end of said length of said handle nearest said head.

Preferably one of said neck and said length of said handle is provided with a biased latching means and another of said neck and said length of said handle is provided with first and second lineally spaced apart seats into which said latching means extend when said handle is in said first and second positions respectively, and wherein, when said handle is moved between said first and second positions, said latching means is forced out of said first or second seats against said bias.

Preferably said biased latching means is provided on said neck and said first and second seats are formed in said length of said handle.

Preferably said first and second seats comprise respective first and second circumferential grooves formed in said length.

Preferably said biased latching means includes at least one member dimensioned so that, while partially housed within said neck, said at least one member can extend into one of said first and second seats.

Preferably said biased latching means further includes a spring clip extending about said neck over said at least one member for biasing said at least one member into one of said seats.

Preferably said member is a ball bearing.

Preferably said biased latching means includes two diametrically opposed members.

Preferably said head is provided with a circumferential recess about said inner circumferential surface for seating said ring gear.

Preferably said pawl means includes two pawls, each pawl having first and second ends where each end of each pawl is provided with one or more teeth for engaging said gear formed on said inner circumferential surface of said hole.

A ratchet tool including at least:

a head;

a ratchet mechanism disposed in said head for rotation about a first axis, said ratchet mechanism including a body adapted for carrying a tool element;

a handle coupled to said head, said handle rotatable about a second axis perpendicular to said first axis, and axially moveable between first and second positions; and, coupling means for coupling said handle to said body when said handle is in said first position whereby rotation of said handle about said second axis causes rotation of said body about said first axis, said coupling means being disengaged when said handle is in said second position;

whereby, torque can be imparted to said body by: turning said handle about said second axis when said handle is in said first position; or, moving said handle about said first axis when said handle is in said second position.

BRIEF DESCRIPTION OF THE DRAWINGS

An embodiment of the present invention will now be described by way of example only with reference to the accompanying drawings in which.

DETAILED DESCRIPTION OF PREFERRED EMBODIMENT

Figure 1:
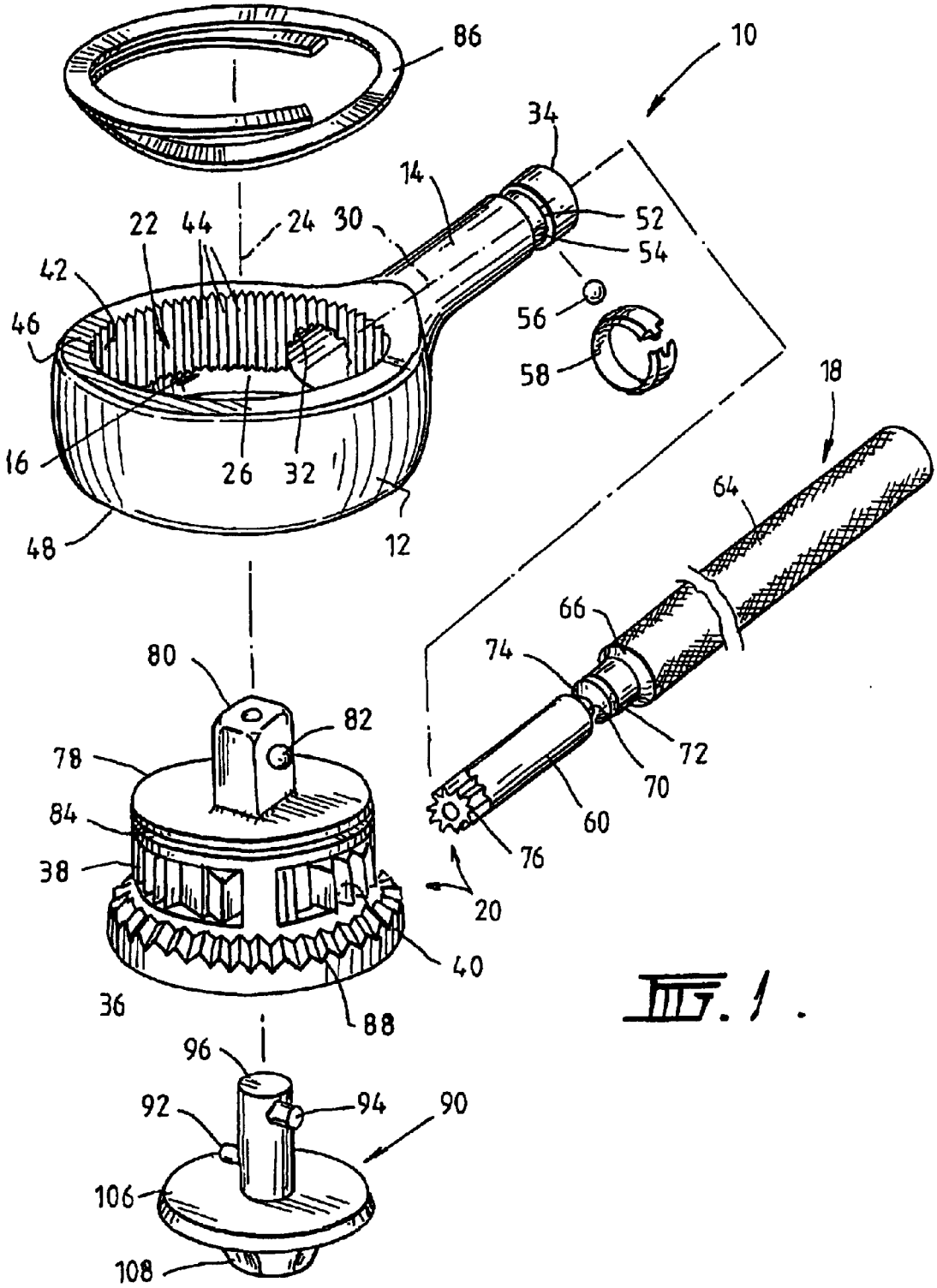
FIG. 1 is an exploded schematic representation of an embodiment of the ratchet tool.

Referring to the accompanying drawings, the illustrated embodiment of the ratchet tool 10 includes a head 12, a neck 14, a ratchet mechanism 16, handle 18 and a coupling means in the form of a transmission 20. The head 12 is provided with a hole 22 having a first axis 24 and an inner circumferential surface 26. The neck 14 depends from the head 12 and is provided with a longitudinal passage 28 which extends along a second axis 30 perpendicular to the first axis 24. As shown most clearly in FIG. 1, the passage 28 opens at one end 32 on to the inner circumferential surface 26. The opposite end of the passage 28 opens at end 34 of the neck 14 distant the head 12.

The ratchet mechanism 16 includes a body 36 provided with pawl means in the form of two pawls 38 and 40 and, a gear 42 formed on and about the inner circumferential surface 26. That is, a part of the ratchet mechanism 16 is formed on the head 12 while the other part, namely the body 36 and pawls 38 and 40 are formed as separate components. In use, the body 36 is disposed within the hole 22. As explained in greater details below, when the tool 10 is in use, torque can be imparted to the body 36 from the handle 18 via the transmission 20 (i.e. the coupling means) when the handle 18 is rotated about the axis 30. Alternately, torque can be imparted to the body 36 via the neck 14 and head 12 by moving or reciprocating the handle 18 about the first axis 24.

Looking at the components of the tool in more detail, it can be seen with particular reference to FIG. 1 and FIGS. 5*a*, 5*b* and 5*c* that the head 12 is in the form of an annular ring with the neck 12 formed integrally with and extending in the same plane as the head 12. The gear 42 is formed as a series of gear teeth 44 which extend axially from one face 46 of the head 12 toward, but stopping short of, an opposite face 48 of the head 12. The remaining portion of the inner surface 26 is formed with a circumferential recess 50.

Near, but in board of, end 34 of the neck 14 is formed a circumferential groove 52. Two transversely extending holes (only one shown) 54 are formed through this grooved portion of the neck 14.

Figures 2, 3, 4, 5A, 5B, 5C, 6, 7A, 7B, 8A, 8B, 8C:
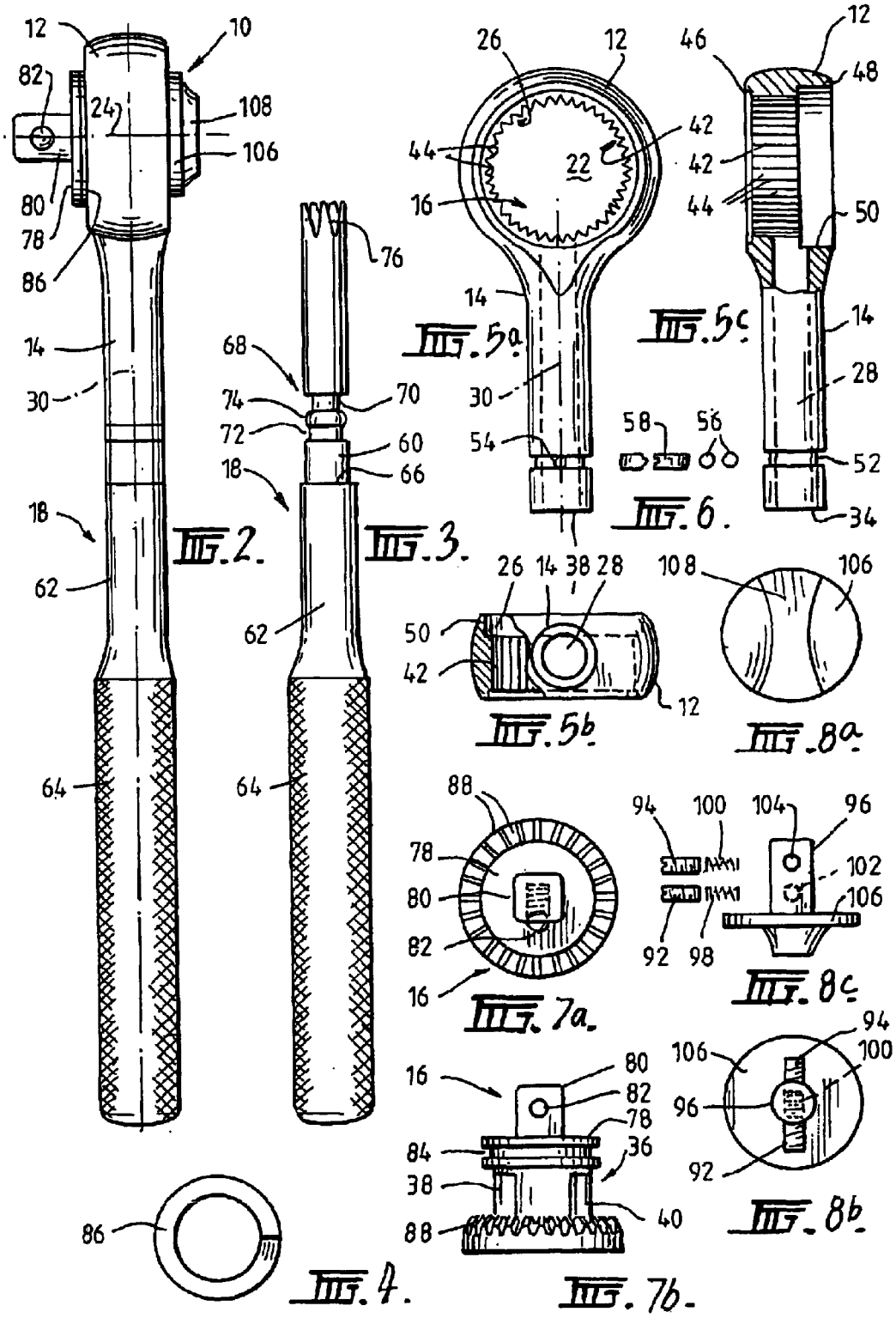
FIG. 2 is a side view of the ratchet tool when assembled.
FIG. 3 is a side view of a handle incorporated in the ratchet tool.
FIG. 4 is a plan view of a spring clip incorporated in the tool.
FIG. 5*a* is a plan view of a head and neck portion of the tool.
FIG. 5*b* is an end view of the head and neck portion shown in FIG. 5*a;*
FIG. 5*c* is a side view in partial section of the head and neck portion shown in FIGS. 5*a* and 5*b;*
FIG. 6 is a representation of a latch incorporated in the tool.
FIG. 7*a* is a plan view of a body portion of a ratchet mechanism incorporated in the tool.
FIG. 7*b* is a side view of the body depicted in FIG. 7*a;*
FIG. 8*a* is a plan view of a ratchet switch incorporated in the tool.
FIG. 8*b* is a bottom view of the switch shown in FIG. 8*a*.
FIG. 8*c* is a disassembled side view of the switch shown in FIGS. 8*a* and 8*b*.

Members in the form of ball bearings 56 are placed in each of the holes 54 (refer FIGS. 1 and 6). A circular spring clip 58 extends about the neck 14 in the groove 52 and over the ball bearings 56.

The handle 18 includes an upper length 60 which extends through the passage 28, a contiguous intermediate length 62 and a further contiguous lower length 64.

The upper length 60 has an outer diameter that is smaller than the outer diameter of the intermediate length 62 thereby forming a circumferential shoulder 66 between the length 60 and 62. The shoulder 66 forms an abutment surface for the end 34 of the neck 14 limiting axial motion of the handle 18 in a direction toward the head 12. The upper length 60 is also provided with a profiled portion 68 which includes two spaced apart circumferential seats in the form of grooves 70 and 72. The grooves 70 and 72 are spaced by a smoothly curved circumferential ridge 74 of a diameter less than that of the remaining portion of the upper length 60.

An upper end of the upper length 60 is provided with a pinion gear 76 which forms part of the transmission 20.

In the illustrated embodiment, the lower length 64 is shown as being provided with a knurled surface to assist in gripping of the handle 18. However, in an alternate embodiment, a hand grip, say made of plastics material, can be connected about the lower length 64 to further assist in gripping of the handle 18.

Referring to FIGS. 1, 7*a* and 7*b*, the body 36, which forms part of the ratchet mechanism 16, includes a cylindrical like body, or hub 78 one end from which a square pin 80 axially extends. The pin 80 is provided with a spring biased locking ball 82. The pin 80 and ball 82 are used for releasably coupling to standard socket tool attachments or elements such as wrenches, Allen key, or screw drivers. Pivotally retained within the hub 78 are the pawls 38 and 40. Each of the pawls is of standard construction and configuration and provided with one or more teeth at each of their respective opposite ends for selectively engaging with the teeth 44 of the gear 42.

A circumferential groove 84 is formed in the hub 78 at a location between the pawls 38, 40 and the pin 80. The groove 84 seats a spring clip 86 which acts to retain the body 36 within the hole 22.

A ring gear 88 is also formed about the hub 78 adjacent an end opposite the pin 82. The ring gear 88 forms part of the transmission 20 and can be engaged by the pinion 76.

The hub 78 is also provided with a switching mechanism 90 to enable switching of the pawls 38 and 40 between first and second positions to facilitate ratcheting of the body 36 in clockwise and anti-clockwise directions. The switching mechanism 90 includes two biased actuating pins 92 and 94 extending transversely from a post 96. The pins 92 and 94 are hollow and extend over respective springs 98 and 100 which sit in blind holes 102 and 104 respectively formed in the post 96. The post 96 extends from a disc 106 which sits in a recess (not shown) formed in the hub 78 at an end adjacent the ring gear 88. A side of the disc 106 opposite the post 96 is provided with a button or grip 108 to allow a user to turn the switching mechanism to change the direction of ratcheting.

The pins 92 and 94 bear against the pawls 38 and 40 respectively and act to pivot the pawls when the switch 98 is turned to change the ends of the pawls which engage the gear 42.

When the tool is in the fully assembled state as depicted in FIG. 2, the handle 18 can be moved axially along the second axis 30 between the first position where the pinion gear 76 engages the ring gear 88, and a second position where the pinion gear 76 is retracted so as to disengage from the ring gear 88. In the first position, the ball bearings 56, which are partially retained within the neck 14 extend into the second groove 72. When the handle 18 is turned about the axis 30, the pinion 76 meshing with the ring gear 88 causes the body 36 to rotate about axis 24. Thus torque can be imparted to the body 38 and pin 80 enabling a socket attached to the pin 80 to be rotated about axis 24. The direction of ratcheting, i.e. direction of rotation of the pin 80, body 36 and handle 18 can be switched by turning of the switch mechanism 90.

This configuration of the tool 10 is particularly useful when the tool is being used in a location which restricts reciprocation of the handle 18 about the axis 24.

However, when there is no significant restriction on the motion of handle 30 about axis 24 the tool 10 can be used by pulling the handle 18 away from the head 12 along axis 30. When this is done, the ball bearings 56 within groove 72 are moved radially outwardly against the bias of spring clip 58 as they traverse the ridge 74, whereafter, the ball bearings 56 snap into the groove 70 by action of the spring clip 58. Now the pinion 76 is disengaged from the ring gear 88 and the tool 10 acts in a conventional manner wherein reciprocation of the handle 30 about axis 34 imparts torque to the body 36 and thus pin 80 by virtue of engagement of the pawls 38 and 40 with the gear 42. However, in contrast with a conventional ratchet tool, the handle 18 is able to still rotate about the axis 30 to accommodate the natural twisting motion of a hand when reciprocating the handle 18 about axis 24.

All modifications and variations that would be obvious to a person of ordinary skill in the art are deemed to be within the scope of the present invention the nature of which is to be determined from the above description and the appended claims.

The claims defining the invention are as follows:

1. A ratchet tool comprising:

a head provided with a hole including an inner circumferential surface which extends about a first axis;

a neck depending from said head and provided with a longitudinal passage extending along a second axis which is perpendicular to said first axis, said passage opening at one end on to said inner circumferential surface, and at an opposite end at an end of said neck remote from said head;

a ratchet mechanism including: a body provided with a pawl and a ring gear, said body disposed in said hole; and, a gear formed on and about said inner circumferential surface for engagement with said pawl;

a handle rotatably retained within said neck and having a length extending into said passage, said handle further including a pinion gear integrally formed at an end of said length closest said body such that said pinion gear is engageable with said ring gear, said pinion gear having a diameter no greater than the width of said handle adjacent said pinion gear;

said handle being axially moveable along said second axis between a first position where said pinion near and ring gear are engaged wherein rotation of said handle about said second axis causes rotation of said body about said first axis, and a second position where said pinion gear and ring gear are disengaged wherein said handle is freely rotatable about said second axis without causing rotation of said body;

a spring clip extending about said neck;

first and second linearly spaced apart seats formed on a length of the handle; and, at least one member retained in said neck and biased by said spring clip to extend into said first seat when said handle is in said first position and said second seat when said handle is in said second position such that, when said handle is moved along said second axis between said first and second positions, said at least one member is forced out of said first or second seat against said bias of said spring clip;

wherein torque is imparted to said body from said handle, via engagement of said pinion gear and said ring gear when said handle is in said first position and rotated about said second axis, or via said neck and head when said handle is in the second position and is moved about said first axis.

2. A tool according to claim 1 wherein said first and second seats comprise respective first and second circumferential grooves formed in said length.

3. A tool according to claim 1 wherein each of said at least one member is a ball bearing.

4. A tool according to claim 1 wherein said at least one member comprises two diametrically opposed members.

5. A tool according to claim 1 wherein said head is provided with a circumferential recess about said inner circumferential surface for seating said ring gear.

6. A tool according to claim 1 wherein said pawl includes two pawl members, each pawl member having first and second ends where each end of each pawl member is provided with one or more teeth for engaging said gear formed on said inner circumferential surface of said hole.

* * * * *